United States Patent [19]

Henderson

[11] 4,314,777

[45] Feb. 9, 1982

[54] TENSION PILE SPLICE

[76] Inventor: Don S. Henderson, 2357 Dora Dr., Clearwater, Fla. 33515

[21] Appl. No.: 54,263

[22] Filed: Jul. 2, 1979

[51] Int. Cl.[3] ..... E02D 5/30

[52] U.S. Cl. ..... 405/251; 405/252

[58] Field of Search ..... 405/251, 252; 52/726, 52/722, 728, 223 R, 223 L, 284, 285

[56] References Cited

U.S. PATENT DOCUMENTS

| | | | |
|---|---|---|---|
| 2,351,288 | 6/1944 | Riches | 405/252 |
| 3,316,724 | 5/1967 | Tsuzuki | 405/251 |
| 3,650,112 | 3/1972 | Howlett et al. | 405/260 |
| 3,988,899 | 11/1976 | Dougherty | 405/252 |
| 4,009,550 | 3/1977 | Young | 52/722 X |
| 4,085,556 | 4/1978 | Sonneville | 52/223 R |
| 4,174,366 | 11/1979 | Schneider | 52/223 R X |

FOREIGN PATENT DOCUMENTS

| | | | |
|---|---|---|---|
| 1320777 | 2/1963 | France | 52/295 |

*Primary Examiner*—Dennis L. Taylor

*Attorney, Agent, or Firm*—Frijouf, Rust & Pyle

[57] ABSTRACT

The disclosure teaches a structure enabling a reinforced concrete pile to be placed in tension. The disclosure illustrates the usual in-service environment of two piles after being coupled in the field and capable of being stressed in tension. Shear pins distribute the tensile load to cast-in-place anchor members. Only that portion of the compression necessary for understanding is illustrated, although the novel features enhance conventional compression capabilities. The foregoing abstract is merely a resume of one general application, is not a complete discussion of all principles of operation or applications and is not to be construed as a limitation on the scope of the claimed subject matter.

9 Claims, 3 Drawing Figures

TENSION PILE SPLICE

BACKGROUND OF THE INVENTION

1. Field of the Invention

This invention relates to concrete piles and more particularly to a tension pile splice.

2. Description of the Prior Art

Concrete piles have many advantages over wood or steel members. However, ordinary steel reinforced concrete is very limited for such use because compression applied to drive a reinforced pile will cause torsion forces which crack and destroy the pile quite easily.

Pre-stressing of beams was suggested early in the 20th Century and has developed rapidly since that time. It was then discovered that pre-stressed piles would confine the damaging tensile wave which is reflected from the pile end after a compression wave, to the limits of the tensile strength of the concrete.

As a consequence, a pre-stressed concrete pile may be driven with many thousands of blows to a refusal of practically zero penetration per blow.

After that development, it became apparent that a substantial improvement in the handling and working capability of the pile could be obtained by making the pile in reasonable length sections and coupling or splicing the piles in the field during the driving operation. A very successful system has been devised for properly coupling such sections in order that the driving force is transmitted through the coupling splice between the piles effectively and efficiently.

Whereas it is normally considered that the forces acting on a pile will be in compression, because that is the purpose of the pile design, nevertheless there are field situations wherein the forces are reversed, or become negative compression, and tend to separate the spice. Obviously separation of a splice during a construction period, for example, could be very disasterous. The prior art has dealt extensively with connectors for compression connections. U.S. Pat. Nos. 1,073,614; 1,838,791; 1,912,111; 3,201,834; 3,422,630; and 3,650,553 are good teaching art in compression structures, and are useful for contrast teaching to the present invention; which has excellent compression capability and novel tension features.

This invention is to be used in conjunction with known pre-stressed pile and compression coupling techniques on structures.

The invention, in particular, relates to the distribution of tensile loading to the body of a pre-stressed concrete pile in such a manner as to distribute loading to a factor below the tensile strength of the concrete.

An object of the invention is to provide a pile coupling which will prevent separation of segments in the event the loading becomes negative for any reason.

Other objects and a fuller understanding of this invention may be had by referring to the summary of the invention, the description and the claims, taken in conjunction with the accompanying drawings.

SUMMARY OF THE INVENTION

The invention is a splice for axially aligned piles, wherein anchors are buried internally of the pile a distance from the pile end, and the anchor devices are coupled one to the other externally of the piles in order to couple the piles against tensile load separation.

This invention accordingly comprises an apparatus possessing the features, properties and the relation of elements which will be exemplified in the article hereinafter described and the scope of the invention will be indicated in the claims.

BRIEF DESCRIPTION OF THE DRAWINGS

For a fuller understanding of the nature and objects of the invention, reference should be had to the following detailed description taken in connection with the accompanying drawings in which.

Similar reference characters refer to similar parts throughout the several views of the drawings.

DESCRIPTION OF THE PREFERRED EMBODIMENT

Figure 1:
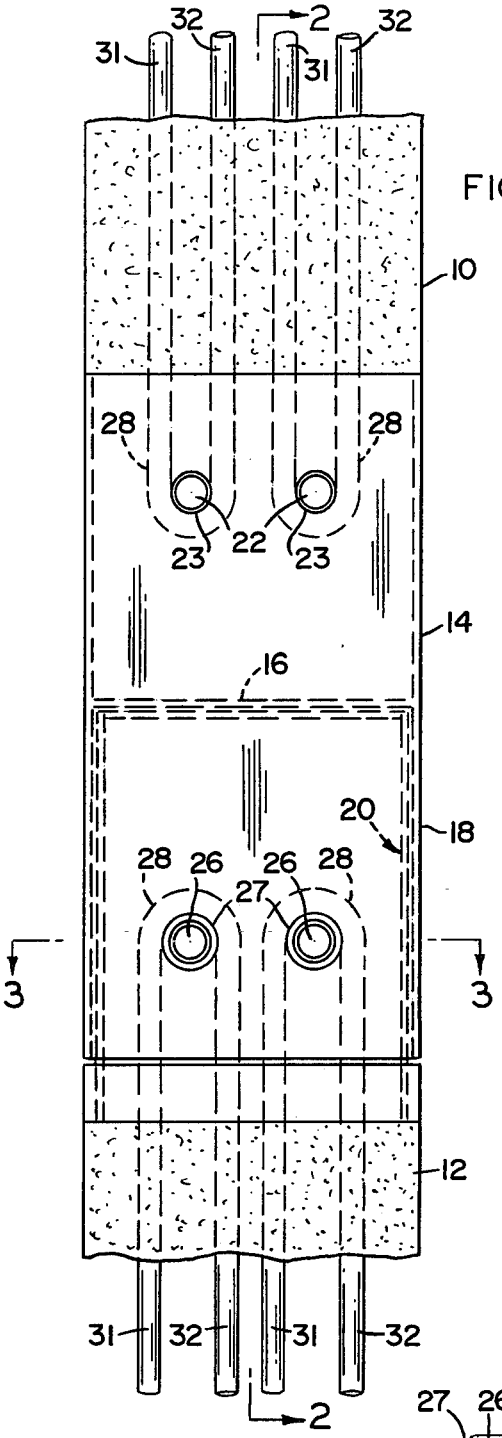
FIG. 1 is an external elevation of the end portions of two aligned and coupled piles embodying the features of this invention.

The FIG. 1 of the drawing illustrates the clean lines and efficient coupling of a first pile 10 and a second pile 12 when built according to the present invention.

Figure 2:
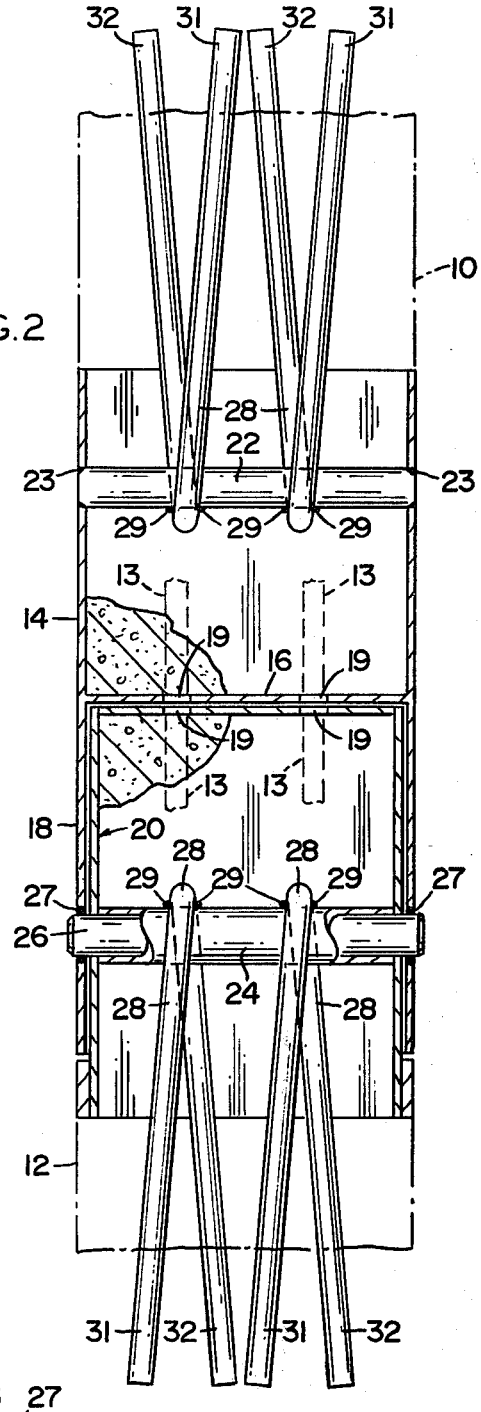
FIG. 2 is a section of the two aligned piles.
Figure 3:
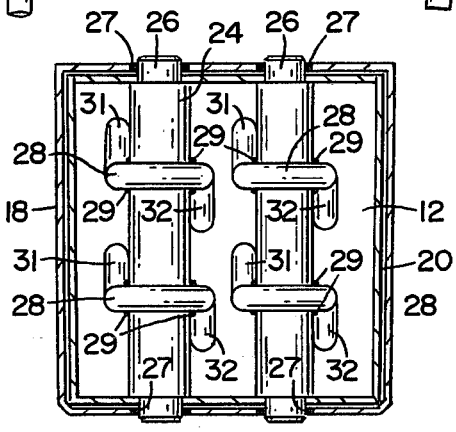
FIG. 3 is a section taken along line 3—3 of FIG. 1.

The FIG. 2 is a section illustration which is provided to teach the concepts of the invention to those skilled in the art. It is not a true sectional view in that the piles are pre-stressed concrete piles and only four fragments of pre-stressed cables 13 are included in the drawing. These cables 13 are shortened in order not to obscure or confuse the illustration of the present invention. The techniques of pre-stressed pile construction are old and well known. In the particular pile construction illustrated, there would normally be approximately eight cables which are drawn through the piles and later trimmed by burning away the excess ends after the concrete has been completely cured. Also, as this description proceeds, it will be apparent that very minor other discrepencies from a true section have been employed in order to better illustrate the invention.

The entire splice is housed within and built about a sleeve 14, which, in many respects, is a bail as defined by Webster's new 20th Century Dictionary, that is, an iron yoke by which to lift heavy objects.

In the preferred method of construction, the sleeve 14 is equipped with an end plate 16 and placed into a pouring form. The end plate is set back within the sleeve 14 in order to define a socket end 18 which is an extension of the sleeve 14.

Concrete is then forced into the form until the presence of the concrete at the face of the plate 16 is detected through vent holes 19.

Although the drawing illustrates the junction between two separate pile structures, the actual construction of the pile is with a male and a female end. Then the male end is fitted with the female end of another similar structure. However the drawing illustrates the invention best by showing those mated ends of two separate piles with the understanding that the opposite ends of the single pile are represented by the two ends shown joined in the drawing. Hence, it is proper to define the invention as a tension pile splice joining a first and second concrete pile, even though the entire structure may be contained within one unit of structure.

The opposite end of the pile, shown in FIG. 2 as being a separate pile mated to the female socket end, is formed as a male configuration. The male end is sheathed in a seal collar assembly 20 and the cables drawn through the vent holes 19 in the end of the assembly in exactly the same manner as described with respect to the female end. When the concrete for the entire pile has properly cured, the cables are burned away and do not project beyond the ends of the plate 16 or the collar assembly 20.

The construction thus described for the pre-stressing construction is simply outlined here for a full understanding of the relationship of the invention to that which is prior art.

Prior to casting the concrete, the sleeve 14 is equipped with shear pin means or set of shear pins indicated in the drawing by the reference character 22. This shear pin means 22 extends transversely through the first pile and interlocks by welding at both ends with the bail sleeve 14. In the FIG. 1, it will be seen that two pins are best employed for most pile construction, and in FIG. 2, the ends of the shear pins are shown welded by welds 23.

In order to enable the connection of the splice in the field, the shear pin means provided for the male end is of a unique construction comprising generally of a pipe sleeve 24 shorter than the interior dimension of the bail sleeve 14, with a shear pin 26 within the pipe sleeve which is at least as long as the exterior dimension of the bail sleeve 14. FIG. 2 shows the shear pin extending slightly beyond the surface of the sleeve.

After the male and female ends are interfitted, and the pin 26 inserted, the pin 26 is welded in place at 27 in order to prevent accidental misalignment and loss of shear pin qualities.

Because the tensile strength of concrete is only about one-twelfth of its compression strength, any tensile loading tending to separate the first and second piles must be distributed throughout a considerable area within the interior of the prestressed concrete. This invention provides anchor means cast within the body of the pile and extending in a generally axial direction of the pile. In practice, it has been found that a reinforcing bar, popularly known as a re-bar, heated to a red heat and bent tightly over the shear pin means and implanted according to this invention, is able to provide a strong and acceptable anchor means. The normal commercial re-bar has a ribbed surface which allows interlocking of the anchor with the concrete of the pile. However, to enhance the capability of the anchor 28 to hold within the interior of the concrete, the re-bar is bent with first and second legs 31 and 32 extending in angular relationship, generally axially of the pile, whereby stress is caused to be applied laterally and longitudinally within the body of the pile whenever tensile stress is placed upon the splice.

The hairpin anchor means is preferably spot-welded directly to the pin 22 or the pipe sleeve 24 in order to hold the anchor pins in place during the pouring and curing of the concrete. The welds are indicated by reference number 29.

Again, the preferred construction embodies two such hairpin anchors on the two shear pin assemblies to give the needed stress distribution.

A bail sleeve bridges the junction of the splice because the female end is defined by the sleeve extending beyond the end of the pile, and thus allows the male end of another pile to be inserted. The shear pin is defined as a "means" because one shear pin may serve in smaller structures, but two pins are preferably, and hence, the shear pins means may be a set. Also, because assembly in the field is required, the male end is shown as a pipe sleeve with a pin insertable in the field and welded in place in the field. Hence, the sleeve and shear pin jointly define a shear pin and is referred to as a shear pin means.

There is little danger of separation by lift-off with piles joined in this inventive concept since there is 100% safety factor in the use of the piles. It has been found that an 80 ton uplift can easily be tolerated with an average 40 ton piles using this construction. Pile segments can be mass-produced at a central location, or on the construction site An efficient use of labor and rigid quality control of materials under ideal conditions insure that unvarying high quality is maintained.

Concrete reinforced pile segments equipped with this invention are easy to handle and to transport. Although a lift point is easy to determine for a pre-stressed pile, these piles may easily be handled by lifting from the female end with no concern over tension disrupting of the material. Sectional piles built with this invention can be driven with full bearing capacity to theoretically unlimited depths in practically all types of soil. There is no diminuation of that characteristic by means of the present invention, and in fact the capability is enhanced.

Spliced piles can also be easily extended above ground to form bearing columns, and wind or shifting structure which may cause disasterous negative loading in other types of splices can easily be maintained with full integrity when this invention is employed.

Because the composite shear pin is installed and welded in the field, after the female end has been dropped over the male end and brought to a rest position, there is a zero tolerance against tensile wave separation of the joint and thus bouncing or tensile wave separation is completely avoided.

The present disclosure includes that contained in the appended claims as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

Now that the invention has been described:

What is claimed is:

1. A tension pile splice joining a first and second concrete pile in axial alignment comprising:

a bail sleeve closely fitted to the first pile and extending beyond the exterior of the end of the pile as a female socket;

a first shear pin means comprising at least one rod extending transversely through the first pile for securing the pile to said bail sleeve, said rod being secured to said bail sleeve;

anchor means secured to said shear pin means within the body of the pile for transfer of stress from said pin means to the interior of the first pile;

said second pile having an end section fitted within the female socket of said bail sleeve;

a second shear pin means being a composite comprising at least one pile sleeve extending transversely through the end section and a rod extending through said pipe sleeve and beyond to engage said bail sleeve, said rod being secured to said socket portion of said bail sleeve; and anchor means secured to said pipe sleeve within the body of the pile to transfer stress from said pin composite to the interior of the second pile, whereby said piles are aligned for compression and anchored against separation under tension.

2. In the structure of claim 1, said anchor means being a rod looped over said shear pin and extending in a generally axial direction of the pile.

3. In the structure of claim 1, said anchor means being a rod looped over said shear pin with first and second legs thereof extending in angular relationship generally axially of the pile, whereby stress is caused to be applied laterally and longitudinally of the pile construction.

4. In the structure of claim 1, said anchor means being two hair pin members with offset legs.

5. In the structure of claim 1, said anchor means being two hair pin members hooked over shear pin and welded thereto.

6. In the structure of claim 1, said shear pin means each being a plural set of lateral pins.

7. In the structure of claim 6, said steel pin of said first shear pin means, said pipe sleeve of said second shear pin means, and all of said anchor means being cast in place in the concrete pile.

8. In the structure of claim 1, said second pile having a collar capping the male end, and dimensioned to fit with a slight clearance within said bail sleeve.

9. A tension pile splice joining a first and second concrete pile in axial alignment, comprising:

a bail sleeve closely fitted to the adjacent ends of aligned first and second piles with the sleeve bridging the junction of the piles to extend axially from each pile end;

first shear pin means extending transversely through the first pile and engaging the sleeve at both ends of the said pin means;

a rod anchor embedded in the body of the pile in load transfer relationship with the first shear pin means;

second shear pin means extending transversely through the second pile and engaging the sleeve at both ends of the said pin means;

a rod anchor embedded in the body of the second pile in load transfer relationship with the second shear pin means;

at least one of the said shear pin means being a composite comprising a pipe sleeve extending transversely through the pile but short of the interior of the sleeve, and an insert lock pin extending through the pipe sleeve and through the wall of said bail sleeve, said lock pin being secured to the bail sleeve.

* * * * *

UNITED STATES PATENT AND TRADEMARK OFFICE

CERTIFICATE OF CORRECTION

PATENT NO. : 4,314,777

DATED : February 9, 1982

INVENTOR(S) : Don S. Henderson

It is certified that error appears in the above-identified patent and that said Letters Patent is hereby corrected as shown below:

Column 1, line 37, "spice" should read -- splice --.

Column 4, line 48, after "the" insert -- exterior of the --.

line 49, delete "exterior of the".

line 61, delete "pile" and insert -- pipe --.

Signed and Sealed this

*Twenty-first* Day of *December 1982*

[SEAL]

*Attest:*

GERALD J. MOSSINGHOFF

*Attesting Officer*

*Commissioner of Patents and Trademarks*